United States Patent [19]

Thünker

[11] 4,290,595

[45] Sep. 22, 1981

[54] ROTATABLE ADVANCE OR FORWARD GRIPPER DRUM

[75] Inventor: Norbert Thünker, Grosssachsen, Fed. Rep. of Germany

[73] Assignee: Heidelberger Druckmaschinen AG, Heidelberg, Fed. Rep. of Germany

[21] Appl. No.: 955,099

[22] Filed: Oct. 26, 1978

Related U.S. Application Data

[63] Continuation of Ser. No. 753,486, Dec. 22, 1976, abandoned.

[30] Foreign Application Priority Data

Dec. 22, 1975 [DE] Fed. Rep. of Germany ..... 2557866

[51] Int. Cl.[3] ..... B65H 5/12; B65H 5/14

[52] U.S. Cl. ..... 271/277; 101/246; 101/409; 271/82

[58] Field of Search ..... 271/277, 247, 82; 101/409, 410, 411, 246, 232

[56] References Cited

U.S. PATENT DOCUMENTS

| | | | |
|---|---|---|---|
| 2,092,189 | 9/1937 | Stobb | 101/410 |
| 2,474,150 | 6/1949 | Jacobson | 271/247 |
| 2,699,115 | 1/1955 | Davidson | 271/277 X |
| 2,988,357 | 6/1961 | Ranger | 271/82 |
| 3,865,362 | 2/1975 | Luffy et al. | 271/82 |

*Primary Examiner*—Bruce H. Stoner, Jr.
*Attorney, Agent, or Firm*—Herbert L. Lerner

[57] ABSTRACT

Continuously rotatable advance gripper drum assembly for sheet-fed rotary printing machines having an advance gripper drum and a gripper bridge movable relative to the drum includes a crank-driven linkage transmission device disposed on and rotatable with the drum and operatively connected to the gripper bridge for moving the gripper bridge.

4 Claims, 10 Drawing Figures

$\gamma_{18,1}$
30°
-30
-60
60°
120°
170°
300°
360°
$\varphi$
37

$\upsilon_{18}$
u
60°
120°
170°
240°
300°
360°
$\varphi$
37

ROTATABLE ADVANCE OR FORWARD GRIPPER DRUM

This is a continuation of application Ser. No. 753,486, filed Dec. 22, 1976, now abandoned.

BACKGROUND OF THE INVENTION

1. Field of the Invention

The invention relates to a continuously rotatable drum varyingly identified herein as an advance or forward or auxiliary gripper drum in sheet-fed rotary printing machines having a gripper bridge movable relatively to the drum.

2. Description of the Prior Art

An advance or forward gripper driven by means of a four-bar linkage chain and without a cam drive has become known heretofore from the German Petty Patent DT-Gbm 7 131 281. This petty patent is concerned with a reciprocatingly rocking advance or auxiliary gripper which requires very long periods of time from the instant the sheet is gripped to the instant it is transfered. Since, on the other hand, the time period between the instant of sheet transfer to the impression cylinder and the instant the gripper rocks back to its starting position is kept much too short, a very long cylinder channel, extending over almost 200°, must be provided in this heretofore known device of the aforementioned German petty patent whereby, in turn, the paper support surface and, therewith, the format length to be processed are considerably shortened. Moreover, poor transmission or transfer relationships are provided due to a relatively small transmission or transfer angle in this known advance or forward gripper device of the aforementioned German petty patent.

In German Petty Patent DT-Gbm 7 217 700 and in German Published Prosecuted Application DT-AS 1 118 811, gripper devices for continuously rotating transfer or sheet feeding cylinders are described wherein the gripper bridge is pivoted or rocked in such manner that the gripper support has zero absolute velocity at the sheet take-up. The pivoting or rocking movement of the gripper bridge in the last-mentioned German petty patent and in the German published application is effected by means of a cam gear and, in the case of the German published application, in conjunction with fixed bolts and pins extending into the fork mouths of control forks.

At high printing speeds, the devices of the foregoing last-mentioned German petty patent and the German published application are subject to limitations with respect to the accuracy of registry during sheet take-up and transfer. Due to the required high angular velocities and angular accelerations of the gripper bridge, large inertial forces are generated, whereby the cam members and cam followers are necessarily subjected to high loads. In order to prevent the cam follower from lifting off the cam member and to ensure force-locking or positive connection therebetween during the required deceleration of the gripper device, powerful springs must be provided, however, such springs constitute an additional load in the acceleration phases of these cam gears.

SUMMARY OF THE INVENTION

Beginning from the foregoing state of the prior art, it is an object of the invention to provide a rotatable advance or forward gripper drum which will ensure take-up of the sheets in registry and transfer thereof to the impression cylinder even at high rotary speeds of the cylinders.

It is a further object of the invention to provide such a continuously rotatable forward or auxiliary gripper drum assembly which permits an increase in the hourly printing output as compared to that for the heretofore known devices of this general type and also ensures sheet take-up from the feed table in registry and sheet transfer to the impression cylinder even at maximal rotary speeds, while the drive thereof must be of compact construction and must be effective exclusively through pivoted linkages and without cam gears or drives. In doing so, favorable transfer or transmission relationships are sought after with a view toward increasing the rotary speed of the printing machine i.e. of the main drive shaft thereof. In accordance with another object of the invention, the movement of the gripper bridge with respect to the rotating auxiliary or forward gripper drum is utilized, in a relatively simple manner, to effect gripper closure after take-up of the sheet from the feed table. It is yet another object of the invention to provide such a forward gripper drum assembly, the production costs and space requirements of which are considerably reduced compared to those of heretofore known devices of this general type.

With the foregoing and other objects in view, there is provided, in accordance with the invention, a continuously rotatable advance gripper drum assembly for sheet-fed rotary printing machines having an advance gripper drum and a gripper bridge movable relative to the drum comprising crank-driven linkage transmission means disposed on and rotatable with the drum and operatively connected to the gripper bridge for moving the gripper bridge.

By disposing the entire advance gripper drive upon the rotary advance gripper drum per se, the space requirements therefor are kept very low and only slightly exceed the dimensions of the advance gripper drum. Moreover, due to this construction according to the invention, assembly thereof is considerably facilitated, and complex cam discs that are costly to produce, and also shaft crankings or pin widenings are rendered completely superfluous. Since a form-locking connection is always provided in such linkage transmission means or system, high rotary speeds of the printing machine can be attained with an advance gripper drive that is free of cam gears.

In order to ensure an especially inexpensive and economic production as well as a high functional reliability of the advance gripper drum assembly, there is provided, in accordance with another feature of the invention, linkage transmission means comprising a plurality of links connected to one another solely by pivot joints.

In accordance with a further feature of the invention, the linkage transmission means comprise a four-bar linkage chain and a two-throw system connected thereto. Such transmission means are controllable dynamically much more simply by far than is a cam gear, by comparison.

To ensure precision already provided by the production, in accordance with an added feature of the invention, the linkage transmission means are mounted by a crank pivot point in the rotatable advance gripper drum, and means are included for driving the linkage transmission means, the driving means comprising a first gear forming a planetary or epicyclic gearing with a second gear forming part of the linkage transmission means. Consequently, the advance gripper drum together with the drive of the gripper bridge can be fully assembled even before installation thereof into the printing machine so that time-consuming orientation and matching of the cam discs and cam followers is dispensed with.

In accordance with an additional feature of the invention, the first gear is fixed to a stationary frame coaxially with the advance gripper drum, the second gear is in meshing engagement with the first gear and is mounted eccentrically in the advance gripper drum, the second gear serving as driving crank of the linkage transmission means, the linkage transmission means including a first connecting rod articulatingly connected to the driving crank, a rocking lever rotatably mounted in the advance gripper drum and connected to the connecting rod, a gripper bridge serving as a driven member, and a second connecting rod connecting the gripper bridge to the rocking lever.

In accordance with yet another feature of the invention, the advance gripper drum assembly includes a stationary machine frame, and the linkage transmission means comprise a crank mounted in the machine frame, a rocking lever connected at one end thereof to the advance gripper drum, the crank being articulatingly connected to the rocking lever, a gripper bridge serving as a driven member, and a connecting rod connecting the other end of the rocking lever to the gripper bridge.

In accordance with a further feature of the invention, the advance gripper drum assembly includes means for bracing the gripper bridge at the machine frame so as to climinate play in joints of the linkage transmission means during take-up of a sheet by tensioning the linkage transmission.

In accordance with an added feature of the invention, a gripper closing cam is disposed on the advance gripper drum and adjustable into variable positions fixable on the drum, the gripper bridge being pivotable and including a pivotable gripper carrying a cam follower guidable on the gripper closing cam so as to effect closure of the gripper with the aid of the pivotability of the gripper bridge during sheet take-up. Accordingly, any additional control means for closing the gripper is rendered superfluous.

In accordance with an additional feature of the invention, the gripper closing cam is adjustable manually on the drum.

In accordance with a concomitant feature of the invention, the gripper closing cam is adjustable automatically.

Other features which are considered as characteristic for the invention are set forth in the appended claims.

Although the invention is illustrated and described herein as embodied in a rotatable advance or forward gripper drum, it is nevertheless not intended to be limited to the details shown, since various modifications and structural changes may be made therein without departing from the spirit of the invention and within the scope and range of equivalents of the claims.

BRIEF DESCRIPTION OF THE DRAWING

The construction and method of operation of the invention, however, together with additional objects and advantages thereof will be best understood from the following description of specific embodiments when read in connection with the accompanying drawings, in which.

DESCRIPTION OF THE PREFERRED EMBODIMENTS

Figure 1:
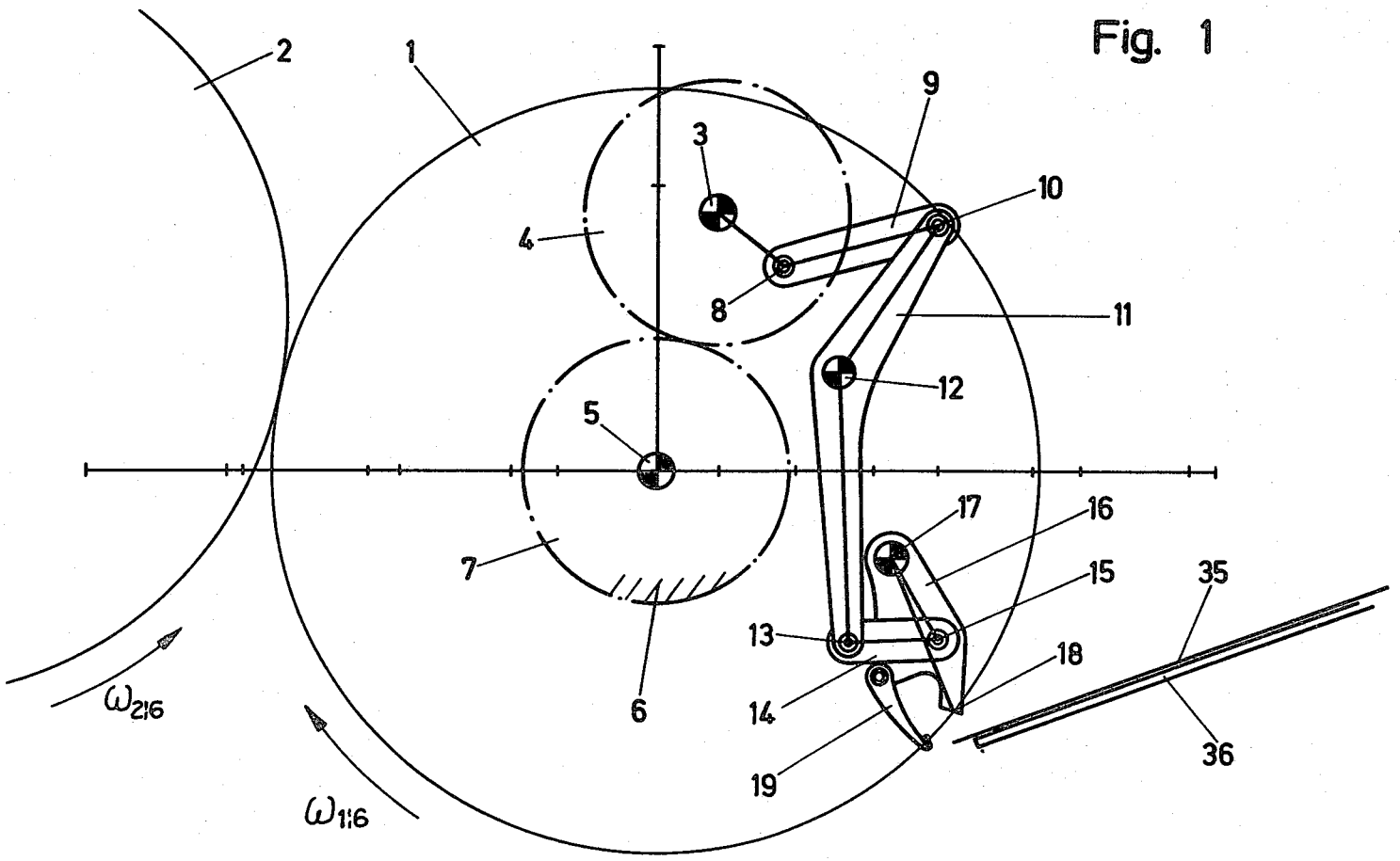
FIG. 1 is a diagrammatic end view of one embodiment of an advance or forward gripper drum constructed in accordance with the invention and having a linkage-mechanism drive operable through epicyclic or planetary gearing in a phase thereof just before sheet take-up from a feed table.
Figure 2:
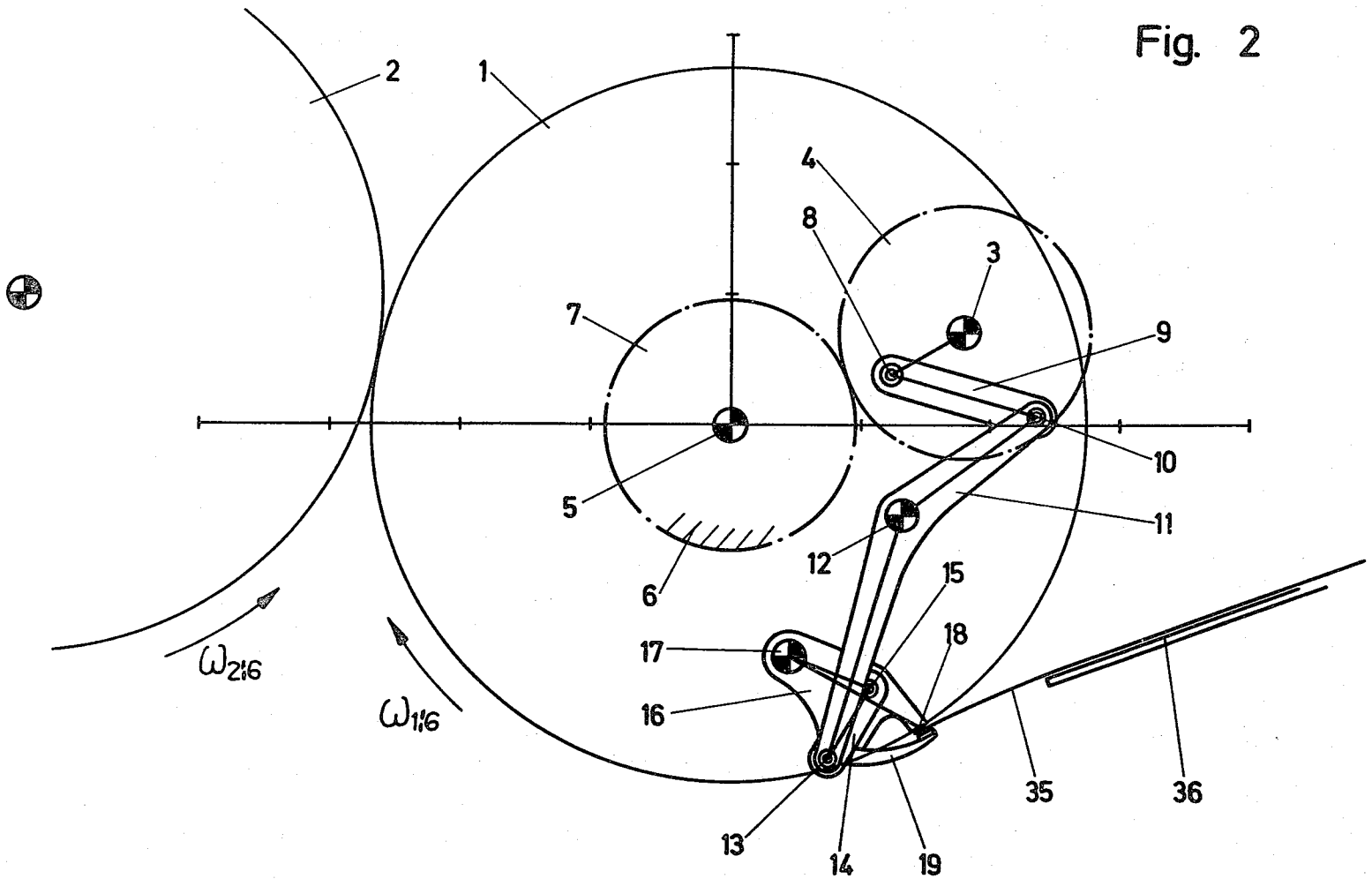
FIG. 2 is another view similar to that of FIG. 1 showing the device in a different phase of the operation thereof just after sheet take-up.

Referring now to the drawing and first, particularly, to FIGS. 1 and 2 thereof, there is shown therein a rotating advance or forward gripper drum 1 driven by an impression cylinder 2 at the rotary speed of the printing machine of which they form a part. Mounted eccentrically at a point 3 in the forward gripper drum 1 is a first gear 4 which is in meshing engagement with a second gear 7 of equal size fastened at a point 5 to the stationary frame 6 of the printing machine coincidentally with or centrically to the axis of the forward gripper drum 1.

For a relative angular velocity $\omega 4{:}1$ of the $|\omega 1{:}6| = |\omega 2{:}6|$ first gear 4 to the forward gripper drum 1, $|\omega 4{:}1, | = |\omega 1{:}6| = |\omega 2{:}6| =$ a constant, where $\omega 1{:}6$ is the relative angular velocity of the forward gripper drum 1 to the stationary machine frame or, in other words, the angular velocity of the forward gripper drum 1, and $\omega 2{:}6$ is the angular velocity of the impression cylinder 2.

One end of a long coupling or connecting rod 9 is articulatingly connected eccentrically to the first gear 4 at a crank pivot point 8 so that when the first gear 4 rolls around on the second gear 7, the distance 3–8 serves as a driving crank for the long connecting rod 9. The other end of the long connecting rod 9 is connected at an articulating joint 10 to one end of an angular rocking lever or bell crank 11 which is rotatably mounted at an articulating joint 12 in the forward or advance gripper drum 1. The rocking lever 11 is connected at the other end thereof at an articulating joint 13 to one end of a short coupling or connecting rod 14, at the other end of which a driven rocker arm 16 is disposed at an articulating joint 15. The articulating joints 3, 8, 10 and 12 thus represent the joints of a four-bar linkage chain to which a two-throw system formed by the articulating joints 13, 15 and 17 is connected.

A gripper bridge functions as the driven rocker arm 16 and is pivotally mounted at a point 17 in the rotating advance or forward gripper drum 1. The gripper bridge 16 is provided with a gripper support 18 and a gripper 19 which, as shown in greater detail in FIGS. 7 to 9, has a rearward end constructed as a roller-carrying lever 20 provided with a cam-follower roller 22.

Figure 7:
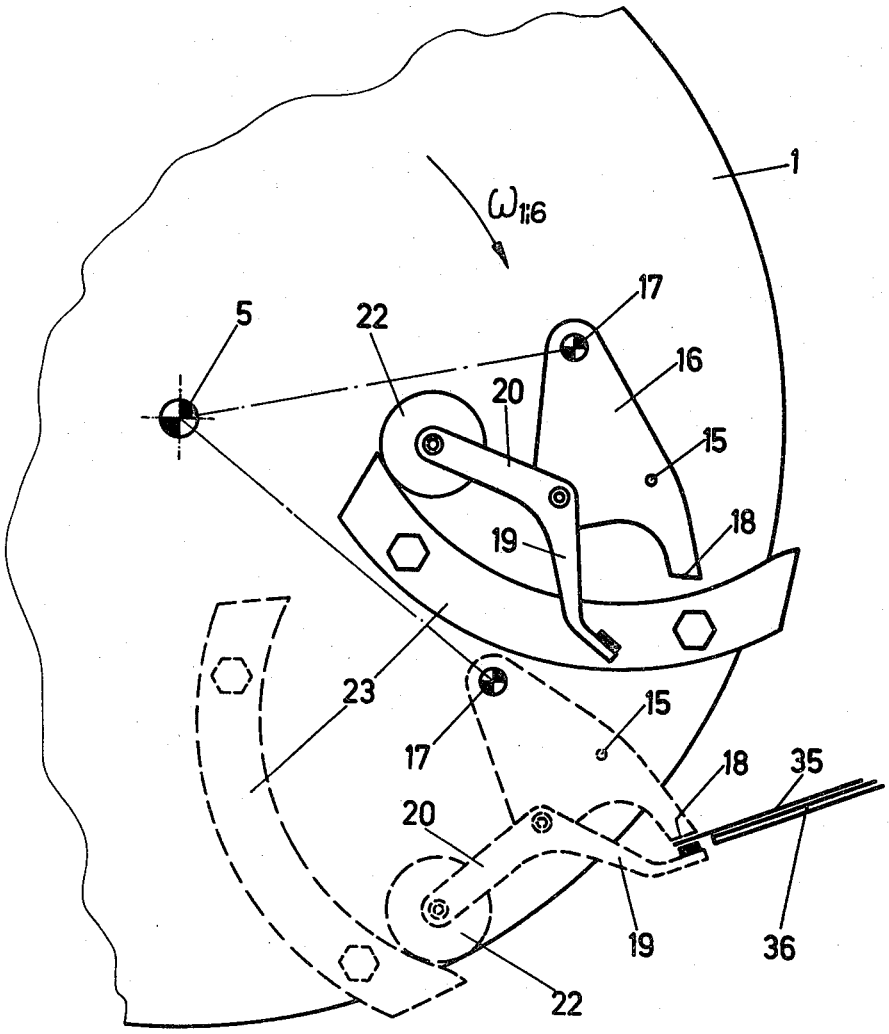
FIG. 7 is a fragmentary diagrammatic view of the end face of the advance or forward gripper drum similar to the view of FIG. 6 wherein the control members effecting gripper closure are shown in solid lines approximately 50° before take-up and in broken lines actually at take-up of the sheet.
Figure 8:
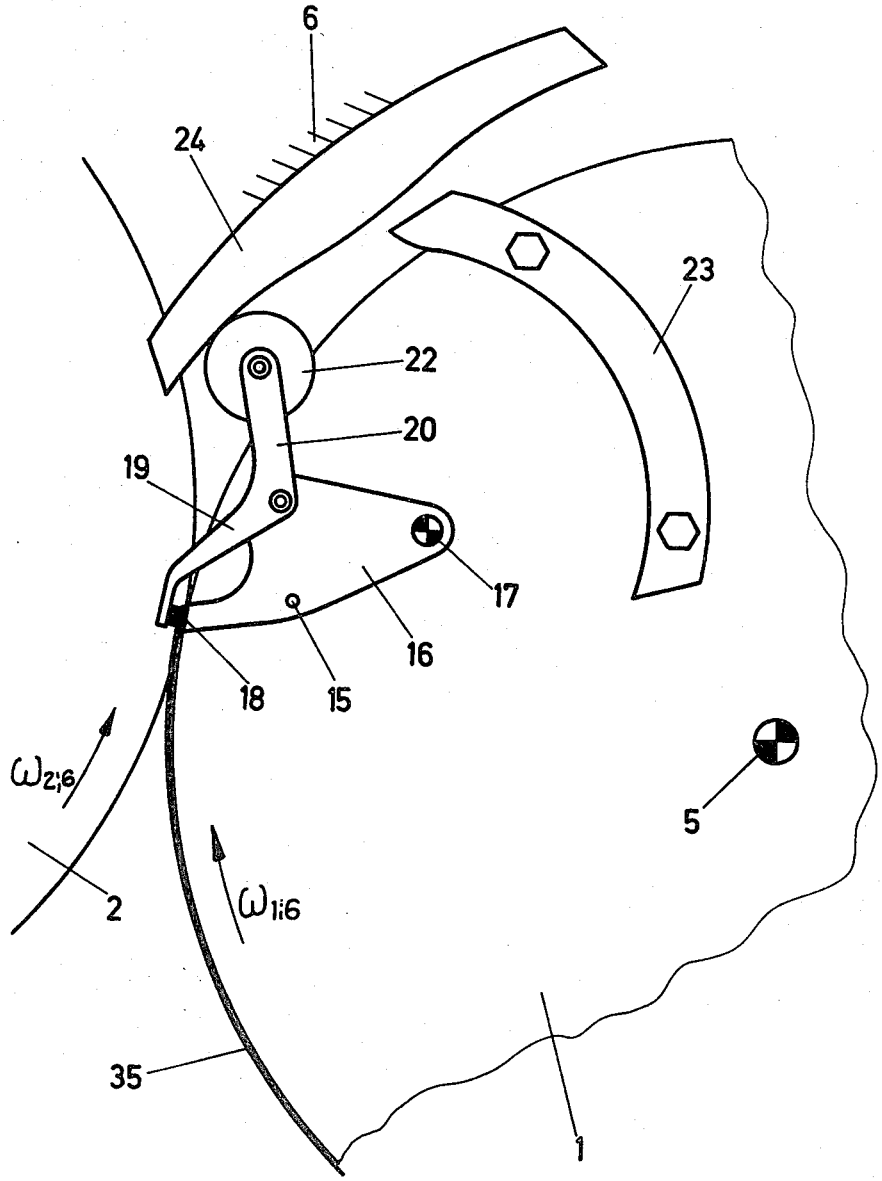
FIG. 8 is a view similar to that of FIG. 7 but showing the control members in a different phase of the operation thereof, namely at the instant wherein they effect gripper opening as the sheet is transferred to the impression cylinder.
Figure 9:
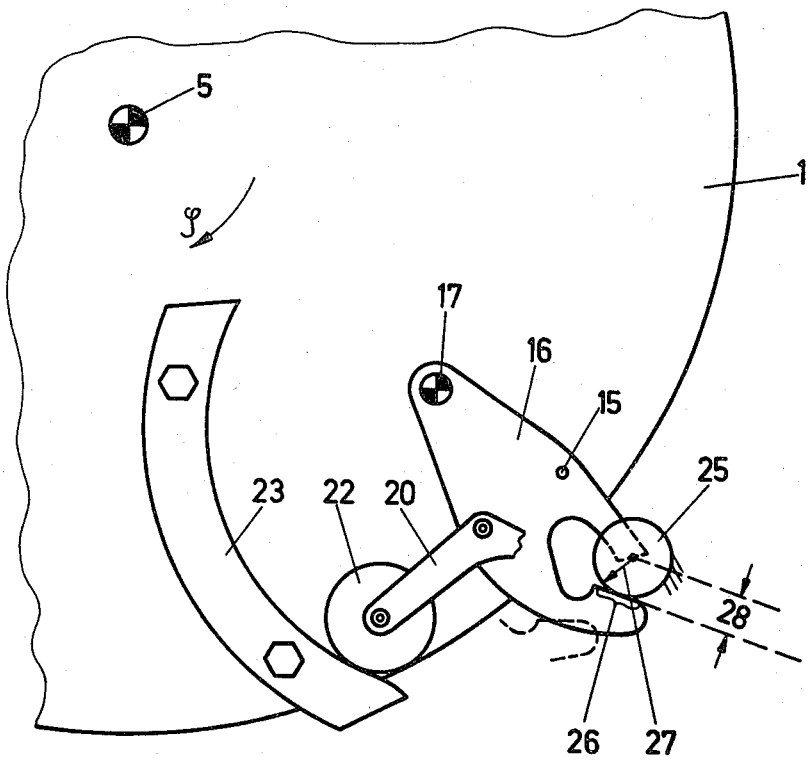
FIG. 9 is another view similar to that of FIG. 7 illustrating a modification for bracing the gripper bridge against the printing machine frame during the sheet take-up operation.

As further shown in greater detail in FIGS. 7 to 9, a gripper closing cam 23 is provided screwed to the forward gripper drum 1 within the working range of the cam follower roller 22. The gripper closing cam 23 can be adjusted into various positions in a relatively simple manner, either manually or by non-illustrated and not further described conventional mechanically or electronically operated means, for example. It would be fully conceivable, for example, to control the gripper closing cam 23 in a manner that it moves out of the working range of the cam follower 22 upon the appearance of a faulty sheet so that the gripper 19 cannot close, and the sheet is consequently not picked up or gripped thereby.

According to FIG. 8, a gripper opening cam 24 is also provided, fastened to the printing machine frame 6 and, like the gripper closing cam 23, disposed within the working range of the path of revolution of the cam follower roller 22, the gripper opening cam 24 being adjustable independently of the gripper closing cam 23.

As shown in FIG. 9, a stay bolt or bracing pin 25 is fastened into the machine frame 6, a straight bracing surface 26 of the gripper bridge 16 coming into engagement therewith during the sheet take-over or transfer. In order to prevent slippage between the straight bracing surface 26 and the stay bolt 25, the latter may also be mounted rotatably in the machine frame 6.

The stay bolt 25 has a radius represented by the arrow 27 in FIG. 9, and the spacing between the straight bracing surface 26 and the axis of the stay bolt 25, which varies progressively due to the pivoting motion of the gripper bridge 16 until it engages the stay bolt 25 is shown at 28 between the associated arrows.

Figure 3:
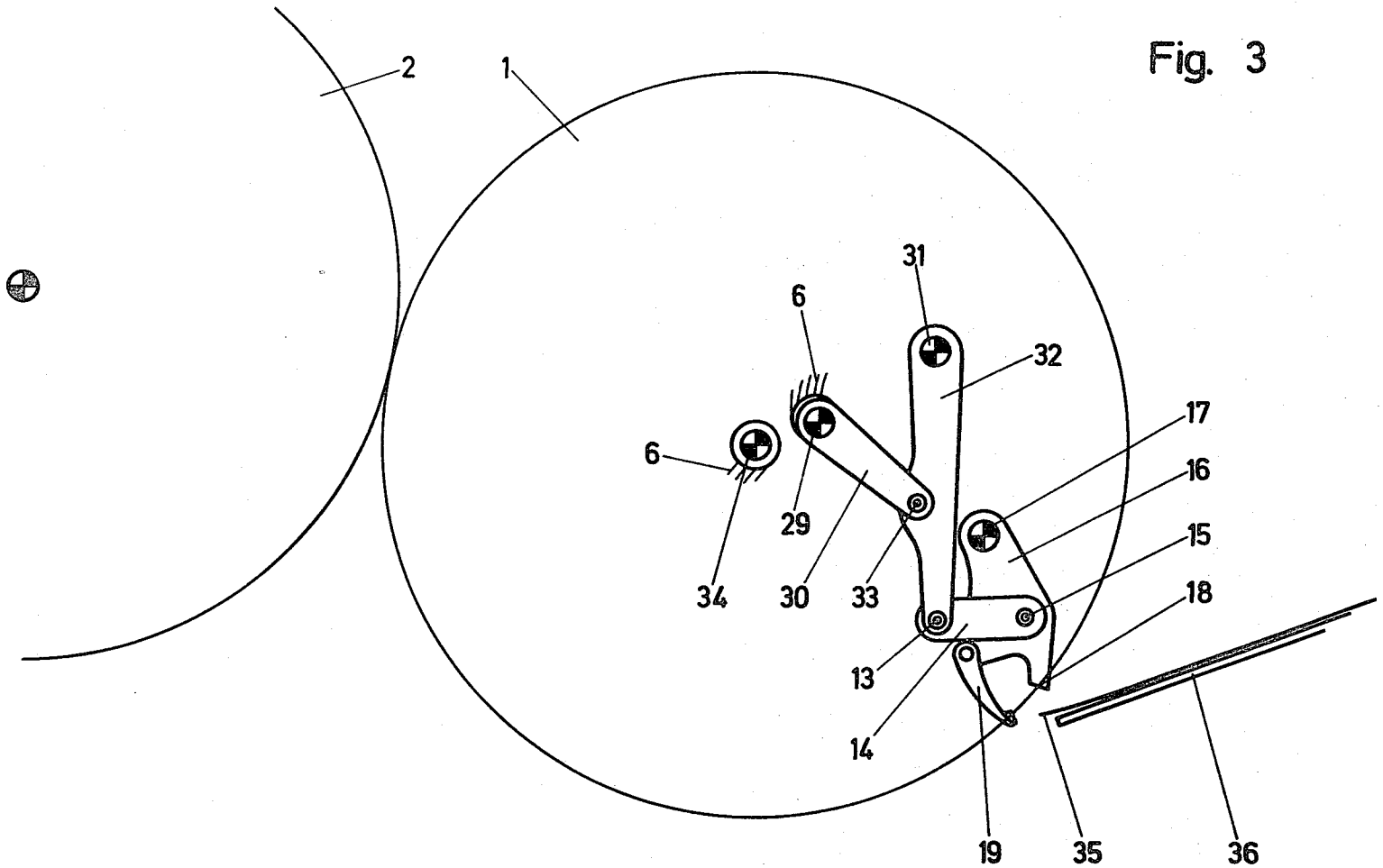
FIG. 3 is a view similar to that of FIG. 1 of another embodiment of the advance or forward gripper drum in a phase thereof just before sheet take-up from the feed table.

In a second embodiment of the invention illustrated in FIG. 3, a rocking lever 32 is mounted at a crank pivot point 31 in the advance or forward gripper drum 1, the rocking lever 32 in a manner equivalent or analogous to that of the first embodiment of FIG. 1, being connected to the gripper bridge 16 through the intermediary of the short connecting rod 14 articulatingly linked at the point 13 to the rocking lever 32 as well as at the articulating joint 15 to the gripper bridge 16. The rocking lever 32 simultaneously serves as a coupling member or connecting rod of a four-bar linkage chain (and, in fact, a double crank mechanism) that is formed by the advance or forward gripper drum 1 mounted at the point 34 in the machine frame 6 together with the revolving crank pivot point 31, by a second crank 30 mounted at a point 29 fixed to the machine frame 6 and having a revolving crank pivot point 33, as well as by the rocking lever 32 mounted on the crank pivot point 33 and on the crank pivot point 31.

The mode of operation of the hereinafore-described embodiments of the invention is more fully explained hereinbelow As shown in FIGS. 1 to 3, the advance or forward gripper drum 1 is driven in a conventional manner by the impression cylinder 2 and rotates at the corresponding rotary speed of the printing machine i.e. of the main drive shaft thereof. The first gear 4 mounted eccentrically at the point 3 in the advance or forward gripper drum 1 is thereby caused to roll around on the second gear 7 of equal size that is fastened to the printing machine frame 6, the relative angular velocity of the rolling first gear 4 to the advance or forward gripper drum 1 corresponding to the absolute angular velocity of the advance or forward gripper drum 1 and the absolute angular velocity of the impression cylinder 2. The bell crank or angular rocking lever 11 is driven by means of the long connecting rod 9 due to the roll-around movement of the first gear 4 on the second gear 7, one arm of the angular rocking lever 11 driving in the desired manner, by means of the short connecting rod 14, the gripper bridge 16 which functions as a driven member.

In a phase position of the gripper bridge 16 just before take-up of the sheet 35 from the feed table 36, namely in a phase between those shown in FIGS. 1 and 2, the gripper support 18 comes into engagement with the sheet 35 and attains a velocity $v_{18}=0$, so that the gripper 19 can grip the sheet 35 in registry and can withdraw it from the feed table 36.

Figure 6:
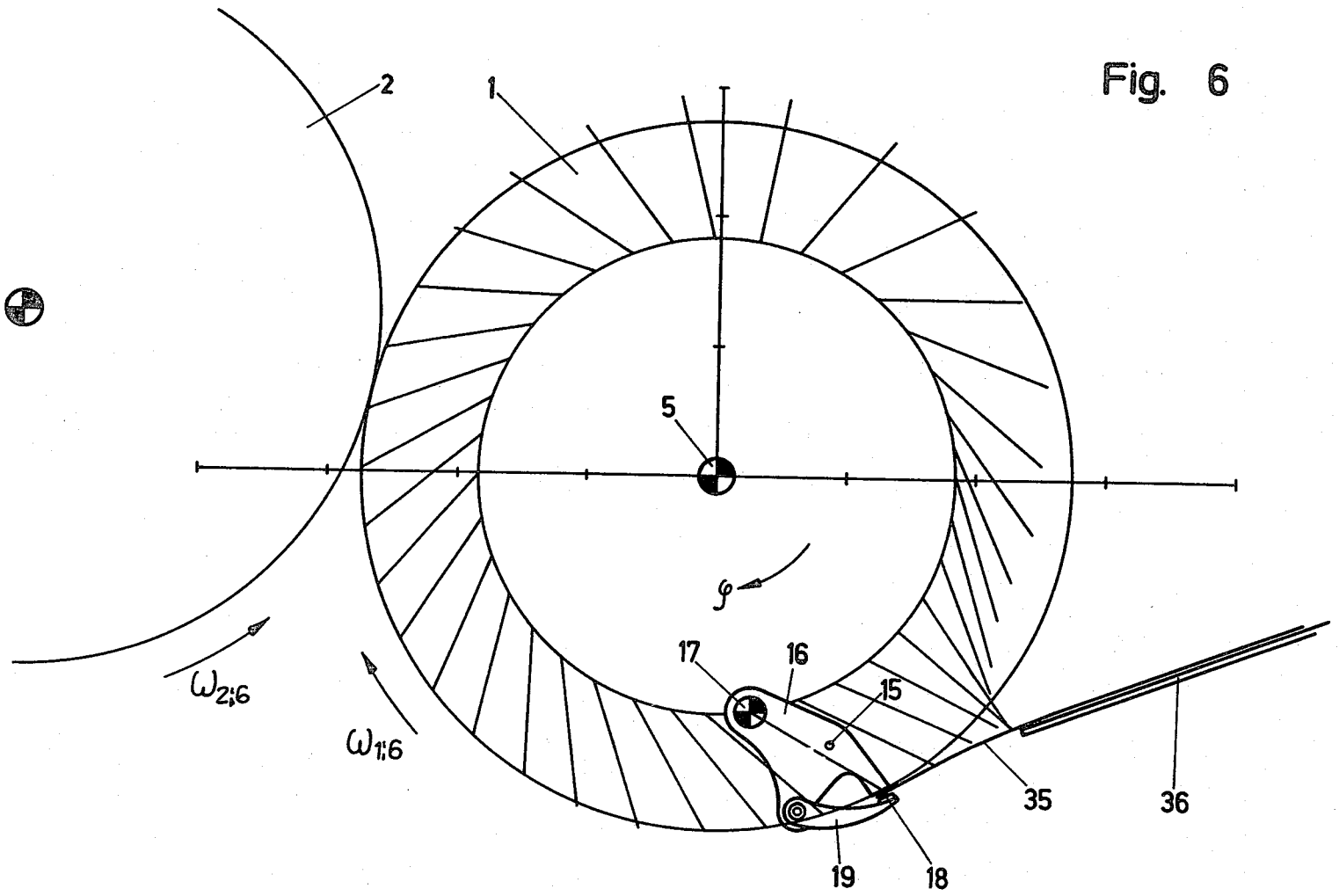
FIG. 6 is another view similar to those of FIG. 1 and FIG. 3, with the linkage mechanisms of both of the latter embodiments omitted, and showing the relative positions of the gripper bridge during a revolution of the auxiliary gripper drum at intervals of 10° of the rotary angle of the printing machine.

In FIG. 2, the advance or forward gripper 19 is shown just after it has taken up or gripped the sheet 35 fed from the feed table 36. In order to render the relative velocity between the advance or forward gripper drum 1 and the paper sheet 35 lying on the drum 1 as low as possible, the gripper bridge 16 is then pivoted additionally only through a few degrees relatively to the forward gripper drum 1 until transfer of the sheet 35 to the impression cylinder 2 occurs. This is especially clearly apparent from the positions of the gripper bridge 16 relative to the forward gripper drum 1, as shown diagrammatically in FIG. 6.

Figure 4:
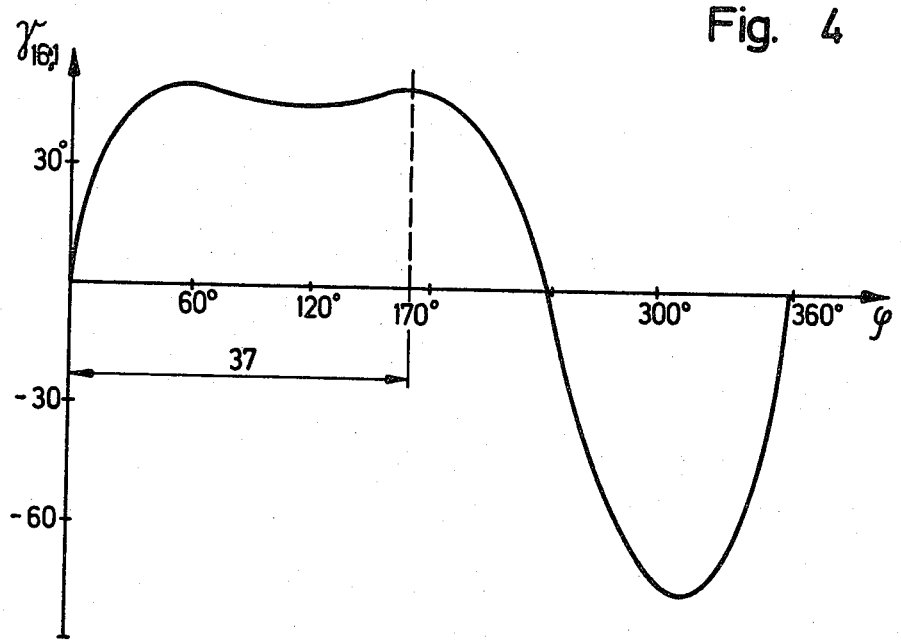
FIGS. 4 and 5 are plot diagrams of the relative pivot angle of the gripper bridge and the speed of the gripper support, respectively, as functions of the rotary angle of the printing press i.e. of the main drive shaft thereof.
Figure 5:
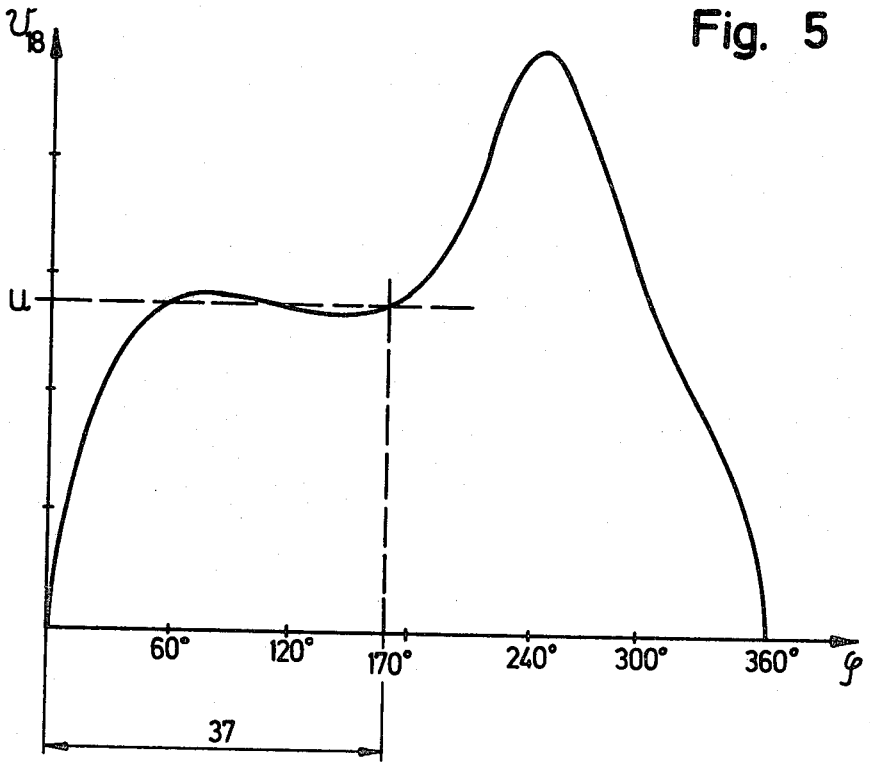

The pivot angle $\gamma$16:1 between the gripper bridge 16 and the forward gripper drum 1 is plotted as a function of the rotary angle $\phi$ of the printing machine or of the main drive shaft thereof in FIG. 4. The distance represented by the double-headed arrow 37 corresponds to the printing machine rotary angle $\phi=170°$ from sheet take-up by the forward gripper 19 from the feed table 35 to sheet transfer to the impression cylinder 2. FIG. 5 shows the corresponding velocity curve of the gripper support 18 as a function of the printing machine rotary angle $\phi$.

Take-up of the paper sheet 35 from the feed table 36 by the forward gripper 19 occurs at the printing machine rotary angle $\phi=0$, the gripper support velocity $v_{18}=0$ and at the pivot angle $\gamma$16:1$=0$. After the sheet take-up, the gripper bridge 16 is initially pivoted a few additional degrees relative to the forward gripper drum 1 up to a printing machine rotary angle $\phi=30°$, however, in the remaining part of the distance represented by the arrow 37 i.e. up to the printing machine rotary angle $\phi=170°$, the pivoting movement of the gripper bridge 16 is virtually at a standstill. Consequently, also the velocity $v_{18}$ of the gripper support 18 and, hence, the velocity of the transported paper sheet 35, as well, remain virtually constant over this period. At $\phi=170°$, the sheet 35 is transferred by the gripper 19 to the impression cylinder. The sheet transfer occurs at a velocity $v_{18}$ of the gripper support 18 which corresponds exactly to the peripheral speed of the impression cylinder 2 and is approximately constant.

For other dispositions and dimensions of the impression cylinder 2 and the feed table 36, the course of movement of the gripper bridge 16 can be accommodated or adapted to the altered relationships by varying the gear dimensions.

The gripper 19 must close at a printing machine rotary angle $\phi=0°$ in order to take up the paper sheet 35 from the feed table 36. The considerable pivoting movement of the gripper bridge 16 for closing the gripper 19 is thereby utilized so that the cam follower roller 22 of the roller lever 20 of the gripper 19 rolls around on the gripper closing cam 23 fastened to the forward gripper drum 1. After the take-up of the paper sheet 35, the gripper bridge 16 pivots even farther about the pivot point 17 thereof, whereby the cam following roller 22 moves free of the gripper closing cam 23. The gripper closure per se is effected in a conventional and therefore non-illustrated manner by means of springs extending between the gripper 19 and the gripper bridge 16.

Control of the gripper movement by means of the gripper closing cam 23 firmly connected to the advance or forward gripper drum 1 guarantees an exact course of movement and permits, moreover, a relatively simple adjustment of the gripper closing point for a printing machine rotary angle $\phi=0$.

At a rotary angle of the printing machine, for example, of $\phi=170°$, the gripper 19 must open again in order to transfer the sheet 35 to the impression cylinder 2. Since no pivoting movement of the gripper bridge 16 about the pivot point 17 thereof occurs during this sheet transfer to the impression cylinder 2, from which a movement for opening the gripper 19, in a similar manner as for the gripper closure, could be derived, the cam follower roller 22 must therefore run up, in a conventional manner, onto a gripper opening cam 24 fixed to the frame 6 of the printing machine. Opening of the gripper 19 is thereby effected, and the sheet 35 can be accepted or taken over by a non-illustrated gripper of the impression cylinder 2 (FIG. 8).

By suitably adjusting the cams 23 and 24, both gripper closure as well as gripper opening can be adjusted independently of one another.

In order to attain maximal accuracy of registry during the printing operation, a bracing of the gripper bridge 16 during the sheet transfer or take-over from the feed table 36 is provided at the frame 6 of the printing machine.

Figure 10:
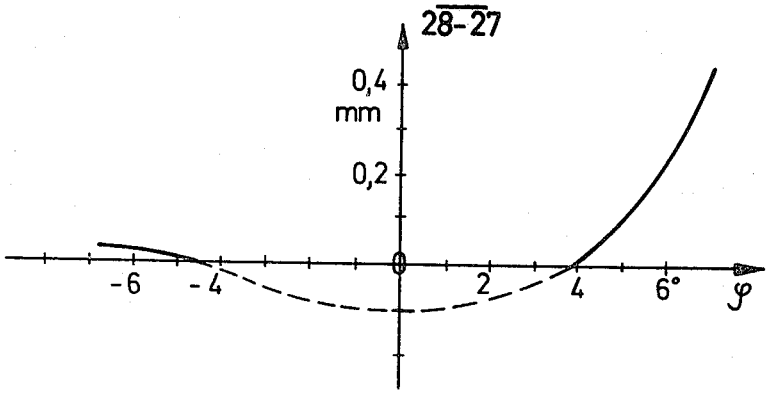
FIG. 10 is a plot diagram of the varying distance between the bracing surface of the gripper bridge and a respective stay or bracing bolt fixed to the machine as a function of the rotary angle of the machine i.e. of the main drive shaft thereof.

Tensioning of the gripper bridge 16 and of the linkage transmission is graphically illustrated in FIG. 10 wherein the printing machine rotary angle $\phi$ is plotted on the abscissa and the spacing of the straight bracing surface 26 from the stay bolt 25 i.e. the distance 28 minus the bolt radius 27, is plotted on the ordinate.

Approximately 5° before take-up of the paper sheet 35, the straight bracing surface 26 of the gripper bridge 16 comes snugly into engagement with the stay bolt 25 fastened to the machine frame 6. The bracing surface 36 can consequently no longer follow the curved path shown by the broken line in FIG. 10, whereby tensioning of the entire linkage transmission by about 0.1 mm takes place with elimination of all play that may be present in the articulating joints. Due to this measure, assurance is provided that the gripper support 18 will assume the same position relative to the paper sheet 35 oriented on the feed table 36 independently of rotary-speed dependent inertial forces for all rotary speeds of the printing machine.

The hereinaforedescribed advance or forward gripper drum 1 is kept very simple in construction by the elimination of or dispensing with the cam discs of heretofore known devices of this general type, and can, therefore, not only be produced especially economically but can also be fully assembled with a saving of time and at relatively low cost, because the advance or forward gripper drum 1 can be installed with the drive of the gripper bridge 16 together as one unit into the printing machine. Tedious aligning and matching of cam discs and cam follower rollers, which are absolutely necessary for conventionally employed cam-linkage transmissions, are thereby eliminated.

Due to the positioning of the entire gripper drive on the advance or forward gripper drum 1, in accordance with the invention, the space requirement is kept very small and only inconsequentially exceeds the space requirement for the advance or forward gripper drum per se. Furthermore, no costly and complex shaft crankings or pin widenings are required.

The forward or advance gripper drum according to the invention is distinguished especially by the fact that it is relatively inexpensive to produce, by its great functional and operational reliability as well as by accurate registry during sheet take-up and sheet transfer.

There are claimed:

1. Continuously rotatable advance gripper drum assembly for sheet-fed rotary printing machines having an advance gripper drum and a gripper bridge movable relative to the drum comprising a camless transmission system including crank-driven linkage transmission means disposed on and rotatable with the drum and operatively connected to the gripper bridge for moving the gripper bridge, said linkage transmission means being mounted by a crank pivot point in the rotatable advance gripper drum, and means for driving said linkage transmission means, said driving means comprising a planetary gearing having a first gear rolling around on a stationary second gear disposed coaxially with the rotatable advance gripper drum, said first gear forming a link in said camless transmission system and being eccentrically connected articulatingly to said linkage transmission means and serving as a driving crank of said linkage transmission means.

2. Continuously rotatable advance gripper drum assembly for sheet-fed rotary printing machines having an advance gripper drum and a gripper bridge movable relative to the drum comprising crank-driven linkage transmission means disposed on and rotatable with the drum and operatively connected to the gripper bridge for moving the gripper bridge, and wherein said linkage transmission means are mounted by a crank pivot point in the rotatable advance gripper drum, and including means for driving said linkage transmission means, said driving means comprising a first gear forming a planetary gearing with a second gear serving as a driving crank of said linkage transmission means, said first gear being fixed to a stationary frame coaxially with the advance gripper drum, said second gear being in meshing engagement with said first gear and being mounted eccentrically in the advance gripper drum, said linkage transmission means including a first connecting rod articulatingly connected to said driving crank, a rocking lever rotatably mounted in the advance gripper drum and connected to said connecting rod, and a second connecting rod connecting said gripper bridge to said rocking lever, the gripper bridge being driven by said second connecting rod.

3. Continuously rotatable advance gripper drum assembly for sheet-fed rotary printing machines having an advance gripper drum and a gripper bridge movable relative to the drum comprising crank-driven linkage transmission means disposed on and rotatable with the drum and operatively connected to the gripper bridge for moving the gripper bridge, and including a stationary machine frame, and wherein said linkage transmission means comprise a crank mounted in the machine frame, a rocking lever connected at one end thereof to the advance gripper drum, said crank being articulatingly connected to said rocking lever, and a connecting rod connecting the other end of said rocking lever to said gripper bridge, the gripper bridge being driven by said rocking lever.

4. Advance gripper drum assembly according to claim 3 wherein said linkage transmission means are formed of links connected by joints and including means for pressing said gripper bridge against said machine frame so as to eliminate play in the joints of said linkage transmission means during take-up of a sheet.

* * * * *